United States Patent [19]

Hottes

[11] 4,340,264

[45] Jul. 20, 1982

[54] MANUFACTURE OF GLASS BASE LAMP

[75] Inventor: Carl J. Hottes, Danbury, Conn.

[73] Assignee: The Perkin-Elmer Corporation, Norwalk, Conn.

[21] Appl. No.: 251,687

[22] Filed: Apr. 6, 1981

Related U.S. Application Data

[63] Continuation of Ser. No. 54,731, Jul. 5, 1979, abandoned.

[51] Int. Cl.[3] ..... H01J 9/26

[52] U.S. Cl. ..... 316/19; 29/25.16

[58] Field of Search ..... 316/19; 29/25.16, 25.15; 313/318, 220, 266

[56] References Cited

U.S. PATENT DOCUMENTS

| | | | |
|---|---|---|---|
| 2,200,939 | 5/1940 | Trebbin | 313/220 |
| 2,417,061 | 3/1947 | Chilcot et al. | 313/266 |
| 2,664,517 | 12/1953 | Wiener | 313/266 |
| 3,132,279 | 5/1964 | Lewin | 313/318 |
| 3,281,751 | 10/1966 | Blair | 339/252 S |
| 3,676,730 | 7/1972 | Loughridge et al. | 313/318 |
| 3,878,419 | 4/1975 | Lafiandra | 313/51 |
| 3,900,237 | 8/1975 | Marcucci | 313/220 |
| 4,277,715 | 7/1981 | Claassens et al. | 313/318 |

*Primary Examiner*—John McQuade

*Attorney, Agent, or Firm*—S. A. Giarratana; E. T Grimes; T. P. Murphy

[57] ABSTRACT

An article of manufacture and a method for manufacturing a mercury vapor lamp wherein a glass mounting base is formed separately and fixed by fusing it to one end of a tubular glass envelope. The glass envelope has an evacuated bore of capillary dimension which is precisely positioned relative to the glass base and in which conductive wires are fixed at each end during the fusing process.

12 Claims, 3 Drawing Figures

MANUFACTURE OF GLASS BASE LAMP

This is a continuation of application Ser. No. 054,731, filed July 5, 1979, now abandoned.

BACKGROUND OF THE INVENTION

In general, gaseous discharged lamps comprise a transparent or translucient glass envelope containing a gas or vapor in an otherwise evacuated enclosure which upon energization glows to provide an intense light. The vapor may be a metalic vapor such as that produced by a small amount of mercury in the evacuated enclosure. Thus, upon energization the mercury forms a vapor which is ionized to create an intense glow.

A common method of energization of the lamp is provided by using electrodes which extend into the enclosure. A potential connected across the ends of the electrodes external to the envelope effects the glow. Lamps of the type described find particular use in mask projection systems of the type disclosed in U.S. Pat. No. 4,011,011 having the same assignee as the present invention wherein photo resist-coated wafers are exposed to the light projection of a mask containing intricate circuit details in the production of integrated circuits. A lamp used in such an environment must be precisely positioned in the optical projection system. Thus, assuming an accurately positioned mounting arrangement the lamp itself must be dimensionally accurate in its configuration.

A lamp manufactured for use in the mask projection system described in the above mentioned patent is disclosed and claimed in the U.S. Pat. No. Re: 30,315 having the same assignee as the present application. This patent describes a lamp having a glass envelope defining a cavity of capillary cross-section and arcuate configuration. One end of the envelope has a metal mounting base fixed thereto whose configuration and relationship to the rest of the envelope is such that upon installation of the base in a mounting fixture the lamp is accurately positioned in its operating environment.

In the manufacture of the lamp, the metal base has an axial bore sufficiently large to receive an end stub of the envelope. The base and envelope are positioned axially, radially and angularly relative to each other with the aid of a jig. An epoxy is then inserted in the annular space defined the outside diameter of the stub and the inside diameter of the bore. The epoxy is allowed to harden and may be aided in the hardening process by heating.

Aside from the time consuming steps required to position and fix the metal base on the glass envelope the use of epoxy, although the best obtainable for firing glass to metal, results in 2–3% of the lamps being discarded due to loose bases.

Also, a defective batch of epoxy can result in the reworking of an entire day's production run.

It has been long felt that substitution of glass base for the metal base would overcome the above disadvantages of the metal base lamp. Since the glass base may be fused onto the envelope, it would eliminate problems associated with use of epoxy. Use of a glass base would lessen the problems of short circuiting since the glass base is insulating. In addition, use of a glass base results in a less costly manufacturing process for the lamp.

SUMMARY OF THE INVENTION

The present invention relates to the method of manufacturing a gaseous discharge lamp of the type described in U.S. Pat. No. Re: 30,315 with a glass base substituted for the metal base disclosed therein.

In the method of the present invention, a glass base with a bore through its length has a tungsten wire fixed midway between its length at one end of the bore to the glass base so that a length of the wire extends partway into the bore and a length extends beyond the termination of the base. The base is then fused to one end of a glass envelope so that a length of the wire extends into a bore within the glass envelope. A glass cylinder has a tungsten wire fixed therein in a similar manner and is fused to the other end of the envelope. The ends of the glass envelope are sealed at or near each fusion point. The bore of the envelope is evacuated and a small amount of vaporizable metal is inserted in the bore. A conductive spring is soldered in the other end of the glass base bore and a terminal is soldered into the other end of the envelope.

DESCRIPTION OF THE INVENTION

Figure 1:
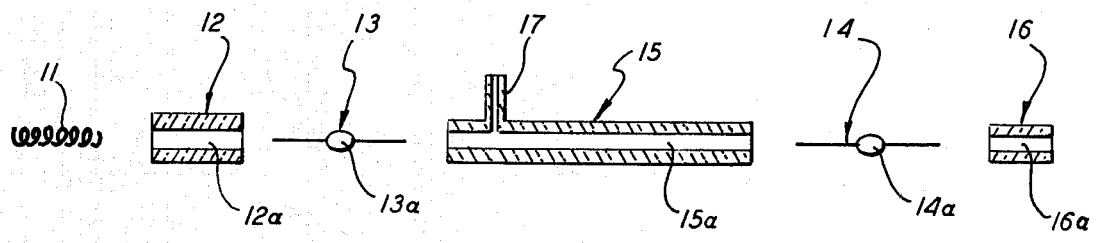
FIG. 1 is an assembly drawing of the lamp of the present invention.

Referring to FIG. 1, there is shown the elements which are used in the manufacture of the present invention. The elements comprise a spring 11, a glass base 12, two lengths of wire 13 and 14, a tubular glass envelope 15, and a glass cylinder 16.

The glass base 12 is made from quartz as are all of the glass elements since it must withstand the relatively high temperature of a gaseous discharge lamp.

The glass base 12 may be of any shape which on mounting in a complimentary shaped mounting block causes the lamp to be accurately positioned within its working environment. However, in a practical embodiment, the glass base 12 is hexagonal with approximately three eights inches between flats and five eights inches in length.

The glass base 12 has an axial bore 12*a* one end of which receives the tungsten wire 13 which is fixed by fusing the glass of the base 12 to the glass bead 13*a*. The other end of the bore 12*a* receives spring 11 which is made of electrically conductive material. As one of the final steps in the fabrication of a lamp, the spring 11 is soldered in the bore 12*a*. One end of the spring 11 protrudes from the bore 12*a* and when mounted in its operating environment provides electrical contact to the wire 13.

The glass envelope 15 has a bore 15*a* of capillary dimension e.g. 6 mm. Extending from the glass envelope 15 and communicating with the bore 15*a* is a tube 17. The tube 17 is used to evacuate the bore 15*a* and also to introduce the mercury into the bore 15*a*. The bore is then fused closed and remains on the lamp only as a small stub. The manner of placing of the tube 17 in envelope 15 forms no part of the method of the present invention.

The glass cylinder 16 has a bore 16*a* one end of which receives wire 14 which is fused to it by means of glass bead 14*a*. The glass cylinder 16 and its bore 16*a* have the same diameters as the envelope 15 and its bore 15*a*.

The glass cylinder 16 is then fused to an end of the envelope 15 with a length of the wire 15 extending into the bore 15*a*.

Once the elements of the lamp are assembled, the lamp is placed in a jig and with the aid of a shadow graph is bent and aligned in two dimensions according to a predetermined pattern. This provides an accurately aligned envelope and base so that when the finished lamp is mounted in its operating environment, it is accurately aligned.

To complete the electrical connection arrangement, a flexible connector such as discussed in U.S. Pat. No. 3,878,419 is soldered in bore 16*a* to electrically contact the wire 14.

Figure 2A:
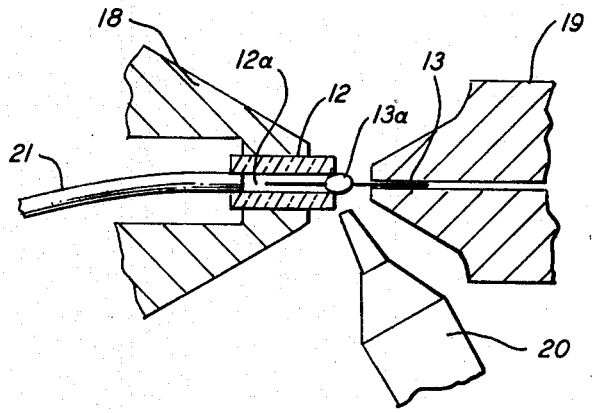
FIGS. 2*a* and 2*b* illustrate steps in the manufacture of the lamp of the present invention.

Referring to FIG. 2*a*, the method of fixing the wire 13 to the glass base is illustrated. The glass base 12 is held in the chuck 18 of the headstock of a lathe. The lathe is not shown but is typical of lathes used in glass working in that both headstock and tailstock pieces may be made to rotate to provide a smoother seal between glass elements.

The tungsten wire 13 is held in a chuck 19 of the tailstock and is therefore accurately centered with respect to the glass base 12. Thus, when the chuck 19 is moved to the left to the position shown, the wire 13 is centered in the bore 12*a* of the glass base 12. In this position the glass bead 13*a* which has a slightly larger diameter than the bore 12*a* is in abutting relationship to the bore 12*a*.

Prior to bringing the glass base 12 and the wire to the position shown the bore 12*a* of the glass base 12 is treated with a glass composition which has good sealing properties to the quartz of the glass base 12, the tungsten wire 13 and the glass bead 13*a*. This is desirable since quartz does not readily adhere to tungsten. The glass composition used in this case is known as GS 10 sealing cane which is a commercial product.

To treat the glass base 12 a stick of the sealing cane is brought slightly into the bore 12*a* while the chick 18 is turning the glass base 12. Simultaneously, the torch 20 heats the cane and glass base 12 to a soak temperature to close the bore 12*a*. Flexible tube 21 which is connected to a source of nitrogen gas (not shown) is caused to blow the excess cane out of the bore 12*a* which is picked up by a scrap piece of quartz manually brought into contact with the cane. At this point the bore 12*a* is coated with the cane and the bore 12*a* is open.

Next, the chuck 19 is moved to the left until the glass bead 13*a* abuts the bore 12*a* as shown. The flow of nitrogen is stopped and the torch 20 is used to heat the glass base 12 and glass bead 13*a* while both are being turned by the lathe. The nitrogen gas is then permitted to flow through bore 12*a* until a small pocket is formed in the glass base 12. This pocket is to aid in holding the solder to be put into the bore at a later stage to physically secure the spring 11 in place as well as to provide for electrical contact to the wire 13.

After this sealing operation, the wire 13 is allowed to cool before removal from chuck 19 to prevent oxidation of the end of the wire 13 which may cause impurities in the capillary or bore 15*a* of the finished lamp.

The glass base 12 and wire 13 are now assembled as a subcomponent of the lamp.

In an identical manner quartz tube 16 is sealed to tungsten wire 14 i.e., glass bead 14*a* and wire 14 are sealed to tube 16 with a length of wire 14 extending somewhat into bore 16*a*. The quartz tube 16 and bore 16*a* are treated with GS 10 sealing cane in a manner similar to the treatment of glass base 12 prior to the sealing operation.

Figure 2B:
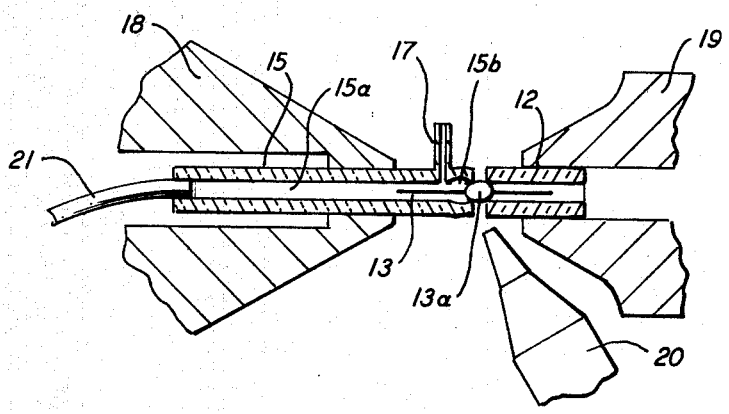

FIG. 2*b* illustrates the steps involved in sealing glass base 12 to the envelope 15. The envelope 15 is held in the chuck 18 of the headstock of the lathe. The glass base 12 having the wire 13 sealed therein as previously described is held in a chuck 19 of the tailstock of the lathe.

The glass envelope 15 and its bore 15*a* is treated with a glass composition such as GS 10 sealing cane. While the end of bore 15*a* is sealed by the sealing cane, nitrogen via tube 21 is introduced into bore 15*a* to form bulge 15*b* at the inner periphery of the bore 15*a* near the end of the envelope 12. The bulge 15*b* serves as a reservoir for the mercury to be put in bore 15*a* later. Then, the rest of the sealing cane is blown out of the bore 15*a* and picked up by a piece of quartz leaving a sufficient amount for aiding the sealing process.

At this time, the glass base 12 is moved to the left by manipulation of the lathe until the remains of glass bead 13 abuts the bore 15*a* of glass envelope 15 with wire 13 inside of bore 15*a*.

While the two chucks 18 and 19 are rotating, the glass envelope 15 and glass base, the torch 20 heats the envelope 15 and glass base 12 to soak temperature to provide the seal. The glass is allowed to cool and with nitrogen flowing through the bore 15*a*, the envelope 15 is baked out by heating it to cherry red. If any oxides appear, the torch 20 is used to chase them toward tube 17 where the nitrogen blows them out. The envelope 15 is allowed to cool and removed from the lathe.

The quartz tube 16 with the wire 14 sealed to it, is sealed to envelope 15 in a manner similar to glass base 12. The bore 15*a* is treated with sealing cane. The envelope 15 and quartz tube are held in the lathe and manipulated and heated until the seal is formed.

The tube 17 is then used to evacuate bore 15*a*, introduce the required amount of mercury and is then, itself, tipped and sealed.

The envelope 15, now assembled into a lamp, is bent on a fixture and aligned in two dimensions against a predetermined pattern such that the lamp when its base 12 is mounted in the complimentary mounting means will be precisely aligned in its operating environment.

The spring 11 and flexible terminal (not shown) are soldered into bores 12*a* and 16*a*, respectively.

On the modifications of the present invention are possible in the light of the above description which should not be construed as limiting the invention beyond those limitations set forth in the claims which follow.

I claim:

1. A method of manufacturing a lamp, comprising the steps forming a tubular glass envelope having a bore therethrough, forming a glass base having a bore therethrough, pretreating said bore of said base with a glass composition for enhancing the adhesion between glass and tungsten, fixing a first tungsten wire in said bore at one end of said base so that said first tungsten wire extends half into and out of said glass base, soldering an axially compressible conducting element into the other end of said bore of said base so that one end of said conducting element makes electrical contact with said first tungsten wire and the other end of said conducting element freely protrudes from said other end of said bore of said base and is compressed when said other end of said bore of said base is abutted against an object, fusing said one end of said base to one end of said envelope such that said first tungsten wire extends into said bore of said envelope, said fusing step forming an airtight seal between said base and said one end of said envelope, forming an airtight seal at the other end of said envelope, evacuating said bore of said envelope, inserting a predetermined amount of vaporizable metal in said bore of said envelope.

2. A method of manufacturing a lamp according to claim 1 wherein said step of fixing further includes the steps of:

forming a glass bead on said first tungsten wire intermediate its end, aligning said first tungsten wire so that said first wire is in one end of said bore of said base and said glass bead abuts said bore of said base, heating said glass bead and said base to their melting points, cooling said glass bead and said base whereby said first tungsten wire is fused to said base.

3. A method of manufacturing a lamp according to claim 2 wherein said step of fixing further includes the step of, spinning said first tungsten wire and said base about their axes during the heating step.

4. A method of manufacturing a lamp according to claim 3 further comprising the step of, fusing a relatively short axially bored glass cylinder to the other end of said envelope which forms said airtight seal at the other end of said envelope.

5. A method of manufacturing a lamp according to claim 4 further comprising the step of, fixing a second tungsten wire in said glass cylinder prior to the step of fusing it to said envelope so that upon fusing said wire extends into said bore of said envelope.

6. A method of manufacturing a lamp according to claim 5 wherein the step of fixing includes the step of, pretreating the bore of said glass cylinder with a glass composition for enhancing the adhesion of said glass cylinder to said envelope and said second tungsten wire.

7. A method of manufacturing a lamp according to claim 6 wherein the step of fixing further includes the steps of, forming a glass bead on said second tungsten wire intermediate its ends, aligning said second tungsten wire so that said second wire is in one end of said glass cylinder and said glass bead abuts the bore of said glass cylinder, heating said glass bead and said glass cylinder to their melting points, cooling said glass bead and said glass cylinder whereby said second tungsten wire is fused to said glass cylinder.

8. A method of manufacturing a lamp according to claim 7 wherein said step of fixing further comprises the step of, spinning said second tungsten wire and said glass cylinder about their axes during the heating step.

9. A method of manufacturing a lamp according to claim 8 further including the steps of, spinning said base and said envelope during the step of fusing each to the other, spinning said glass cylinder and said glass envelope during the step of fusing each to the other.

10. A method of manufacturing a lamp according to claim 9 further comprising the step of, soldering a flexible electrically conducting terminal into the other end of said glass cylinder to fix it therein in electrical contact with said second tungsten wire.

11. A method of manufacturing a lamp according to claim 1 further comprising the step of, bending said glass envelope in at least two directions to conform to a predetermined pattern.

12. A method of manufacturing a lamp according to claim 10 further comprising the step of, bending said glass envelope in at least two directions to conform to a predetermined pattern.

* * * * *

UNITED STATES PATENT AND TRADEMARK OFFICE

CERTIFICATE OF CORRECTION

PATENT NO. : 4,340,264
DATED : July 20, 1982
INVENTOR(S) : Carl J. Hottes

It is certified that error appears in the above-identified patent and that said Letters Patent are hereby corrected as shown below:

Column 1, line 9, change "translucient" to --translucent--, line 12, change "metalic" to --metallic--, Column 3, line 39, change "chick" to --chuck--, Column 4, line 47, change "On the" to --Other--, line 48, delete first "the"

Signed and Sealed this

*Twenty-fifth* Day of *January 1983*

[SEAL]

*Attest:*

GERALD J. MOSSINGHOFF

*Attesting Officer*

*Commissioner of Patents and Trademarks*